United States Patent [19]

Lees et al.

[11] 3,989,923

[45] Nov. 2, 1976

[54] WIRE HEAT TREATING APPARATUS

[75] Inventors: John Lees; Kenneth Taylor, both of Great Dunmow, England

[73] Assignee: International Standard Electric Corporation, New York, N.Y.

[22] Filed: Nov. 15, 1974

[21] Appl. No.: 524,120

Related U.S. Application Data

[63] Continuation of Ser. No. 397,033, Sept. 13, 1973, abandoned.

[30] Foreign Application Priority Data

Nov. 11, 1972 United Kingdom ..... 46781/72
Feb. 13, 1973 United Kingdom ..... 6943/73

[52] U.S. Cl. ..... 219/155; 148/156; 219/119; 339/5 RL; 339/278 C

[51] Int. Cl.² ..... H05B 3/00

[58] Field of Search ..... 191/56; 219/50, 119, 219/155, 10.47; 339/5 R, 5 P, 5 RL, 8 R, 8 RL, 278 C; 148/156

[56] References Cited

UNITED STATES PATENTS

| | | | |
|---|---|---|---|
| 1,176,614 | 3/1916 | Stanley | 219/119 |
| 1,347,917 | 7/1920 | Sheperdson | 219/155 X |
| 3,267,253 | 8/1966 | Gueugnier | 219/155 |
| 3,518,405 | 6/1970 | Herren et al. | 219/155 |
| 3,612,819 | 10/1971 | Gibson | 219/155 |
| 3,746,582 | 7/1973 | Gentry | 148/156 X |
| 3,821,511 | 6/1974 | Sugano et al. | 219/155 |

*Primary Examiner*—Arthur T. Grimley
*Assistant Examiner*—N.D. Herkamp
*Attorney, Agent, or Firm*—John T. O'Halloran; Thomas M. Marshall

[57] ABSTRACT

Apparatus for a continuous tandem electrical heat treating process for wire conductors for cables uses electrical contact pulleys having faces of a high melting point conductive material such as tungsten-copper. The melting point of the material is at least 1200° C. The novel apparatus has reduced wear, arcing and wire breakage. Free running pulleys are also used instead of driven ones to avoid excessive tension. The free running pulleys have low torque contacts to apply high electrical current to heat the wire.

15 Claims, 3 Drawing Figures

WIRE HEAT TREATING APPARATUS

This is a continuation of application Ser. No. 397,033 filed Sept. 13, 1973, now abandoned.

BACKGROUND OF THE INVENTION

1. Field of the Invention

This invention relates to apparatus for producing wire conductors for cables, and in particular to improved heat treating apparatus for such wire conductors.

2. Description of the Prior Art

In the manufacture of plastics coated telephone cable the metallic conductor wires are normally drawn, and then annealed, before being coated with plastics insulation. Sometimes these three processes are carried out entirely separately and independently of each other, but a preferred method of manufacture involves a tandem arrangement of the drawing and annealing process stages, or alternatively a tandem arrangement of all three stages, so that there is an uninterrupted flow of wire through the stages that are arranged in tandem.

For tandem operation an annealing method is required which will operate in a continuous mode of operation on the wire as it emerges at line speed from the drawing process. A common method of on-line annealing involves passing a large electrical current through the wire as it moves on between a system of two or more electrically conductive contact pulleys, which are connected to a current source, and so act as rolling contacts. Using this annealing method with the known type of phosphor-bronze pulleys, or alternatively, pulleys with tyres or contact faces of phosphor-bronze, copper wire is easily produced in an annealed condition suitable for further processing into telephone cables. In order to minimize wire breakage the contact pulleys are driven at a rate providing a small amount of slip ensuring that the peripheral speed of the pulleys is never allowed to be exceeded by the line speed of the wire passing over them. The slip is prone to produce sparking at points of contact, but in practice causes minimal damage, and the wear on the contact pulleys, although significant, can be tolerated. If however the same apparatus is used to anneal wire of other materials, such as aluminum, much less satisfactory results are produced. In particular there is excessive wear of the contact pulleys and sparking which results in a poor surface finish and a much higher incidence of wire breaks. The known apparatus also generally uses driven guide pulleys which may result in excessive tension in the wire. The use of free-running electrical contact pulleys for wire annealing is also known, such as shown in U.S. Pat. No. 2,109,555 issued Nov. 5, 1935. These provide some reduction of the wire tension, but still further reductions are desirable.

SUMMARY OF THE INVENTION

It is therefore the primary object of the present invention to provide an improved annealing process utilizing electrical contact pulleys that can be employed with various wire conductor materials, and using low friction structures to reduce wire tension.

These and other objects and advantages are achieved by novel apparatus for annealing bare work-hardened wire conductors including two or more electrically conductive pulleys over which the wire passes and between which an electric current is established via the wire. The pulley surfaces coming in contact with the wire are faced with, a high-melting point electrically conductive material having a melting point of not less than 1200° C. Examples of suitable materials include two-phase tungsten-copper and tungsten-silver materials, and tungsten, titanium, tantalum and their carbides. Where a high melting point surface layer is to be used this layer may comprise for example a layer of chromium, a cobalt-chromium-tungsten composition, or a boride, nitride or carbide layer.

According to another aspect of the invention there is provided apparatus for annealing or thermal conditioning of bare wire conductors including two or more electrically conductive pulleys over which the wire passes and between which an electric current is established via the wire wherein the pulleys are free-running being driven solely by the passage of the wire. In order to avoid excessive tensioning of the wire, such pulleys are supported in low friction bearings which have a small moment of inertia and are equipped with low torque electrical contact gear.

There follows a description of an annealer embodying the invention in a preferred form as taken in conjunction with the accompanying drawings.

DESCRIPTION OF THE PREFERRED EMBODIMENTS

Figure 1:
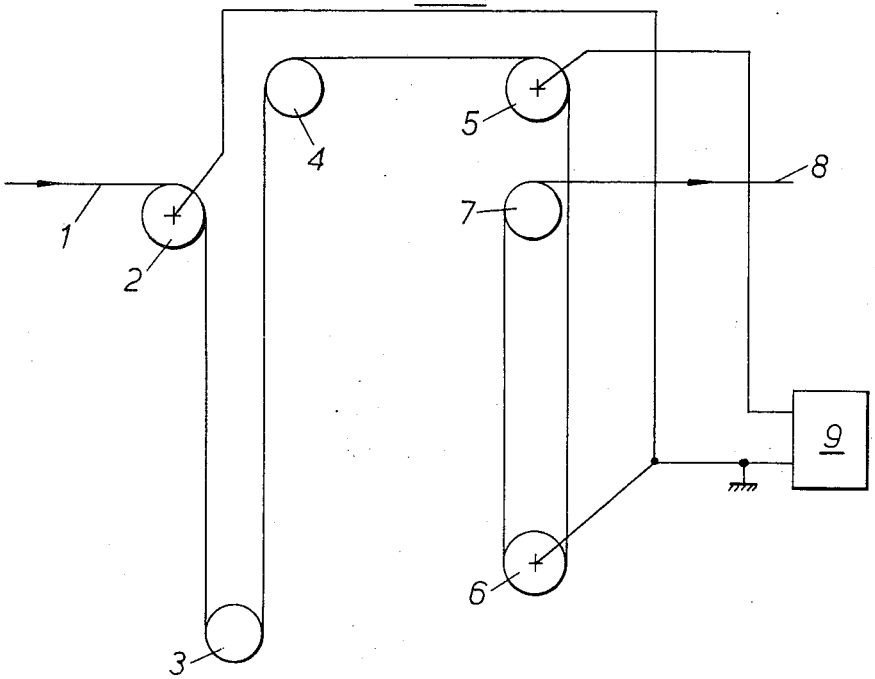
FIG. 1 is a schematic diagram of the general layout of the annealer suitable for use with wire of various materials such as copper or aluminum.

Referring to FIG. 1, wire 1 issuing from a drawing machine (not shown) passes over a first electrical contact pulley 2, over electrically insulated guide pulleys 3 and 4, over second and third electrical contact pulleys 5 and 6, and finally over guide pulley 7 to emerge from the annealer at 8. Pulleys 2 and 6 are connected to the ground or earthed side of an electrical current supply 9, while pulley 5 is connected to the live side of the supply. This use of three contact pulleys is designed to restrict the current flow provided by the supply 9 to the region of wire within the annealer irrespective of any electrical connection that may be established between portions of the wire before and after the annealer. The length of wire between pulleys 2 and 5 is made much longer than that between pulleys 5 and 6 so that the former forms a pre-heater section which precedes the main annealing which occurs between pulleys 5 and 6. Pulley 6 is cooled by directing a jet of air or water at it. This cooling reduces the plasticity of the wire at this point thereby permitting a greater tension to be applied to the wiring to draw it through the annealer. If desired, the wire may be wrapped right round this pulley so that it executes a turn and a half before leaving it.

Figure 2:
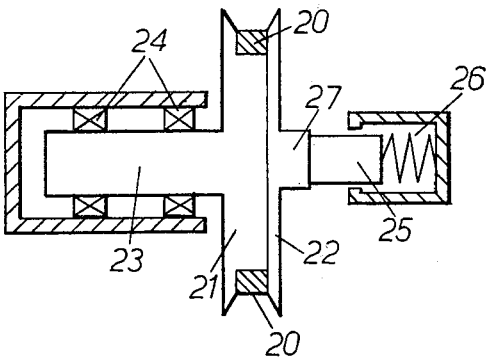
FIG. 2 depicts a section through one of the contact pulleys.

The electrical contact pulleys 2, 5 and 6 are all of substantially the same construction shown in greater detail in FIG. 2. The preferred material for the electrical contact surface of the pulley to the wire is a tungsten-copper two-phase material sold under the name "Elkonite" having a melting point of at least 1200° C. Other suitable materials include tungsten-silver, tungsten, titanium, tantalum and their carbides. In addition, high melting point surface layers of chromium, a cobalt-chromium-tungsten composition, or a boride, nitride or carbide layer, may be used. The contact takes the form of a replaceable tyre or annular ring 20 on a split pulley composed of portions 21 and 22. The pulley rotates on a shaft 23 supported by low friction bearings 24 of the precision ball journal type.

An alternative type of tyre or ring 20 consists of a steel ring with a facing of titanium carbide produced, for example, by a surface chemical reaction with a volatile titanium salt. An alternative construction for the low friction bearings 24 uses a bearing of the air supported type.

Figure 3:
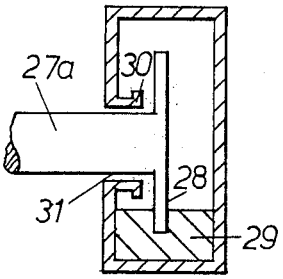
FIG. 3 depicts a molten metal contact arrangement optionally replacing the carbon brush contact arrangement depicted in FIG. 2.

The pulley is electrically connected with the power supply by the carbon brush 25 of brush gear 26 bearing on the end of a boss 27. An alternative form of electrical contact is depicted in FIG. 3. The boss 27*a* is longer and carries a flange 28 at its end dipping into molten metal 29 contained in a heated vessel provided with a gland or system of baffles 30 preventing the splash of metal out through the aperture 31 accommodating the boss 27*a*.

It should be understood that the invention is applicable to the annealing of various wire conductor materials such as copper and aluminum, as well as nickel and tinned copper. The apparatus has uses other than that of annealing and may also be uesd for thermal conditioning wire to raise it to a suitable temperature for encasing it in plastics insulation. The wire in this case may already be fully annealed. Use of such high melting point materials as tungsten-copper for annealing aluminum wire has increased the lifetime of the pulley faces by a factor of more than five. A similar modification of apparatus for preheating aluminum wire before coating with plastics insulation has increased lifetime by a factor of more than 10.

What is claimed is:

1. Electrical heat treating apparatus for solid wire electrical conductors comprising a plurality of electrical contact pulleys and insulated guide pulleys feeding a wire conductor along a predetermined path, and means applying electrical current to said contact pulleys and wire for heating said wire, said contact pulleys having wire contacting faces of a metallic material having a melting point of at least 1200° C and a relatively high resistance to wear.

2. The apparatus of claim 1 wherein said wire contacting faces are of a metallic material selected from the group consisting of tungsten, tungsten-copper, tungsten-silver, titanium, tantalum, carbides of said materials, chromium, and cobalt-chromium-tungsten.

3. The apparatus of claim 2 wherein said pulleys are free-running and driven by the passage of wire thereover.

4. The apparatus of claim 3 including three contact pulleys, the length of the wire between the first and second contact pulleys being much longer than that between the second and third contact pulleys to form a preheated section preceding the main heating between said second and third contact pulleys.

5. The apparatus of claim 4 wherein said first and thid contact pulleys are connected to a ground reference potential and said second contact pulley is connected to the high potential side of said electrical current means to restrict current flow to the region of wire between said contact pulleys.

6. The apparatus of claim 3 wherein each of said contact pulleys include two engaging split portions, the wire contacting faces being a replaceable ring on one of said portions, said ring having a high melting point surface layer of a material of said group thereon.

7. The apparatus of claim 6 wherein said wire contacting faces include a steel ring having a facing of titanium carbide.

8. The apparatus of claim 3 wherein said contact pulleys include a shaft, and low friction ball journal bearings supporting said shaft.

9. The apparatus of claim 8 wherein said contact pulleys include an axial rotatable boss having a carbon brush and brush gear connecting said electrical current means to said contact pulleys.

10. The apparatus of claim 8 wherein said contact pulleys include an axial extended rotatable boss having a flange, a heated vessel around said flange, said vessel including a molten metal contacting said flange and a baffle preventing escape of said molten metal around said boss.

11. A wire annealer for annealing a solid bare strand of aluminum wire conductor comprising:

means supplying said bare wire along a predetermined path, means for tensioning said bare wire in a manner to avoid deformation and breakage of said wire, a plurality of contact pulleys directing said bare wire along said path, said plurality of contact pulleys are individually and separately mounted along said path to receive said single solid strand of wire, means for cooling said wire to permit application of increased tension thereto, means applying electrical current to said contact pulleys for heating said wire, and wherein said contact pulleys have wire contacting faces of a metallic material having a melting point of at least 1200° C.

12. The device of claim 11 wherein said wire contacting faces are of a metallic material selected from the group consisting of tungsten, tungsten-copper, tungsten-silver, titanium, tantalum, carbides of said materials, chromium and cobalt-chromium-tungsten.

13. The apparatus for electrically heat treating solid wire electrical conductors by passing electrical current through a portion of said wire between at least two electrical contact pulleys, each of which has an electrically conductive wire contacting face, while said wire is moving at production speeds along a predetermined path, said path being determined by a plurality of insulated pulleys and said electrical contact pulleys, the improvement which comprises forming said electrical contact pulleys from two engaging split portions supporting wire contacting faces formed from an electrically conducting metallic material having a melting point of at least 1200° C and a high resistance to wear by said solid wire electrical conductor.

14. The apparatus of claim 13 wherein said wire contacting faces are a metallic material selected from the group consisting of tungsten, tungsten-copper tungsten-silver, titanium, tantalum, carbides of said materials, chromium, and cobalt-chromium-tungsten.

15. The apparatus of claim 13 wherein each of said pulleys is mounted so as to be free running driven only by said wire, whereby said pulleys avoid increasing the tension of said wire during said heat treating.

* * * * *